US008555791B2

(12) United States Patent
Jin et al.

(10) Patent No.: US 8,555,791 B2
(45) Date of Patent: Oct. 15, 2013

(54) FOLDING TABLE WITH LOCKING MECHANISM

(75) Inventors: Ju-Young Jin, Xiamen (CN); Cai Yixian, Shishi (CN)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 13/559,003

(22) Filed: Jul. 26, 2012

(65) Prior Publication Data

US 2013/0025509 A1 Jan. 31, 2013

Related U.S. Application Data

(60) Provisional application No. 61/513,427, filed on Jul. 29, 2011, provisional application No. 61/531,075, filed on Sep. 5, 2011.

(51) Int. Cl.
*A47B 3/083* (2006.01)

(52) U.S. Cl.
USPC ..... 108/168; 108/127; 108/160; 108/169; 108/174

(58) Field of Classification Search
USPC ..... 108/126, 115, 118, 121, 124, 125, 127, 108/129, 14, 133, 132, 160, 166, 167, 168, 108/169, 173, 174; 248/166, 439, 188.6, 248/292.12
See application file for complete search history.

(56) References Cited

U.S. PATENT DOCUMENTS

| | | | | |
|---|---|---|---|---|
| 2,643,926 | A | 6/1953 | Pucci et al. | |
| 2,760,559 | A | 8/1956 | Austin et al. | |
| 2,994,093 | A | 8/1961 | Wagner | |
| 3,093,095 | A | 6/1963 | Howe et al. | |
| 3,141,424 | A * | 7/1964 | Seymour | 108/171 |
| 4,218,092 | A | 8/1980 | Schach et al. | |
| 4,927,128 | A | 5/1990 | O'Brian | |
| 6,223,661 | B1 * | 5/2001 | Griepentrog | 108/169 |
| 6,334,400 | B1 * | 1/2002 | Nien | 108/115 |
| 6,565,156 | B1 | 5/2003 | Yamashita et al. | |
| 7,278,515 | B2 | 10/2007 | Moser et al. | |
| 7,299,754 | B2 * | 11/2007 | Stanford et al. | 108/132 |
| 7,621,224 | B2 | 11/2009 | Lin et al. | |
| 7,707,948 | B2 * | 5/2010 | Lin | 108/169 |
| 2004/0187749 | A1 * | 9/2004 | Zhurong et al. | 108/169 |
| 2005/0274302 | A1 * | 12/2005 | Jin et al. | 108/126 |
| 2008/0022906 | A1 * | 1/2008 | Stanford | 108/132 |
| 2008/0202390 | A1 | 8/2008 | Branch et al. | |
| 2008/0284216 | A1 | 11/2008 | Mayercheck | |

OTHER PUBLICATIONS

International Search Report and Written Opinion dated Oct. 15, 2012 from PCT International Application No. PCT/US2012/048480.

* cited by examiner

*Primary Examiner* — Janet M Wilkens
*Assistant Examiner* — Daniel Rohrhoff
(74) *Attorney, Agent, or Firm* — Maschoff Brennan

(57) ABSTRACT

A foldable table may include a table top and legs that are movable between an extended position and a collapsed position. The table top may include a first section and a second section that are connected by a hinge assembly. A locking member may be sized and configured to lock the hinge assembly in a fixed position. Advantageously, moving the legs between the extended and collapsed positions may cause the locking mechanism to move between the locked and unlocked positions. Thus, when the legs are in the extended position and the locking mechanism is in the locked position, the table top may be secured in the unfolded position.

17 Claims, 14 Drawing Sheets

FOLDING TABLE WITH LOCKING MECHANISM

CROSS-REFERENCE TO RELATED APPLICATIONS

The present application claims priority to and the benefit of U.S. Provisional Patent Application Ser. No. 61/513,427, entitled FOLDING TABLE WITH LOCKING MECHANISM, which was filed on Jul. 29, 2011, and is hereby incorporated by reference in its entirety.

The present application claims priority to and the benefit of U.S. Provisional Patent Application Ser. No. 61/531,075, entitled TABLE, which was filed on Sep. 5, 2011, and is hereby incorporated by reference in its entirety

BACKGROUND OF THE INVENTION

1. Field of the Invention

The present invention generally relates to furniture and, in particular, to tables that are capable of being folded and unfolded 2. Description of Related Art Many different types of tables are well known and used for a variety of different purposes. For example, conventional tables may include legs that are pivotally attached to a table top and the legs may be movable between a use position in which the legs extend outwardly from the table top and a storage position in which the legs are folded against an underneath portion of the table top. Conventional tables with relatively large table tops and folding legs are often referred to as "banquet tables" and these types of tables are frequently used in assembly halls, banquet halls, convention centers, hotels, schools, churches and other locations where large groups of people meet. When the tables are no longer needed, the table legs can be moved into the storage position and the tables may be moved or stored.

Conventional banquet tables with movable legs may allow the table to be more conveniently stored. The table top for many conventional banquet tables with movable legs, however, may retain its relatively large size and shape. For example, many known banquet tables have a length between six and ten feet and a width between three and four feet. As a result, many conventional banquet tables require a large storage area even when the legs are in the collapsed position. This large storage area may be especially problematic for larger facilities such as hotels, schools and churches because a considerable number of these tables may have to be stored. Thus, a significant amount of space may be required to store the tables. In addition, smaller facilities such as restaurants, offices and homes may use one or more conventional banquet tables. These smaller facilities may use the tables less frequently, such as during special occasions. Conventional banquet tables, even when the legs are folded, are often too bulky and awkward to be conveniently used and stored at such smaller facilities. As a result, it is often necessary for both larger and smaller facilities to rent and/or borrow one or more banquet tables when needed. Disadvantageously, this process of renting and/or borrowing banquet tables can be inconvenient, time consuming and costly.

Conventional banquet tables are also often difficult to move or transport from one location to another. For example, because of the length of many conventional banquet tables, it is often difficult for a single person to move the table. In addition, the extended length of banquet tables may preclude the tables from being transported in the trunk or back seat of a typical passenger car. Accordingly, conventional banquet tables may have to be transported by a truck, trailer or oversized vehicle such as a sports utility vehicle. These and other factors may make conventional banquet tables time consuming and expensive to move.

It is also known to construct tables that are capable of being folded in half. In particular, conventional fold-in-half tables include a table top with two sections pivotally connected by hinges. The two sections usually have the same size and shape, and the hinges are typically located at the center or middle of the table top. The two sections of the table top may be moved between an unfolded position in which the sections of the table top are generally aligned in the same plane and a folded position in which the two sections are positioned generally adjacent to each other for storage.

Disadvantageously, many conventional fold-in-half tables with foldable table tops are unable to support a significant amount of weight. For example, the connection between the two sections of the table top for many known fold-in-half tables is relatively weak, which may cause, for example, a portion of the table top to sag or slump. Additionally, the connection between the table top sections for many known fold-in-half tables may be relatively frail and may break if a significant load or force is applied to the table top. In order to construct a stronger table top, it is known to make the sections of the table top out of stronger and thicker materials. Undesirably, this may increase the weight of the table top, which may make the table more difficult to manufacture, ship, carry and move.

An additional shortcoming of many conventional fold-in-half tables is the tables may be relatively difficult and time consuming to use. For example, multiple steps may be required to set up and take down many conventional tables. In particular, a conventional folding table may have to be unfolded, two or more legs moved from a collapsed position to an extended position, a first locking ring may have to be moved into a locked position to secure the first leg in a locked position, a second locking ring may have to be moved into a locked position to secure the second leg in a locked position, and then an apparatus may be used to lock the table top in the use position. Thus, many steps may be required before the table can be used. In addition, numerous steps may be required to fold or store the table. For instance, the apparatus used to lock the table top in the use position may have to be unlocked, and the first and second locking rings may have to be moved from the locked positions to the unlocked positions. The first and second legs may then be moved from the extended to the collapsed positions, and then the table top may be folded. Therefore, numerous steps may be required each time the table is used, moved and/or stored.

BRIEF SUMMARY OF EMBODIMENTS OF THE INVENTION

A need therefore exists for a table that eliminates or diminishes the disadvantages and problems described above.

One aspect is a table that may include a table top and one or more support structures or legs that may be used to support the table top in a use position. The support structures may be movable between an extended or use position and a collapsed or storage position relative to the table top. When the support structures are in the use position, the support structures may extend outwardly and away from the table top. When the support structures are in the collapsed position, the support structures may be disposed generally parallel and at least proximate a lower or underneath portion of the table top. At least a portion of the support structures may contact or abut the lower portion of the table top when the support structures are in the collapsed position. Advantageously, when the support structures are in the use position, the table may be used to support a wide variety of objects and the table may be used for many different purposes. When the support structures are in the collapsed position, the table may be more easily moved, stored and/or transported.

Another aspect is a table that may include a table top that is capable of being folded and unfolded. For example, the table top may include two sections that are generally aligned in the same plane when the table top is in the unfolded position. The two sections of the table top may be generally positioned parallel and adjacent to each other when the table top is in the folded position. The table may also include support structures that are movable between use and collapsed positions. Advantageously, if the table includes both a foldable table top and support structures that can be moved between use and collapsed positions, the table may be stored in a relatively compact area. This may also allow, for example, a single person to easily move and transport the table. In addition, this may allow the table to be positioned in a relatively small area, such as the backseat or trunk of an automobile. Further, this may allow one or more tables to be shipped and/or stored in relatively small areas, which may allow transportation and storage costs to be decreased.

Still another aspect is a table that may include a table top constructed from plastic and the plastic table top may be constructed using a blow-molding process. Advantageously, a blow-molded plastic table top may be lightweight, easily constructed and formed into a desired shape, size, configuration and design. The blow-molded plastic table top may also be generally weather resistant and temperature insensitive, which may allow the table to be used in a wide variety of locations and environments. In addition, the blow-molded plastic table top may be durable, long-lasting and corrosion resistant. Further, the blow-molded plastic table top may be relatively strong and used to support a relatively large amount of weight. Significantly, the blow-molded plastic table top may form a structural member of the table and various features may be integrally formed in the table top as part of a unitary, one-piece construction.

Advantageously, a blow-molded plastic table top may be relatively strong because it may include opposing walls or surfaces separated by a distance. In particular, the opposing walls may be separated by a generally constant distance and the table top may have generally uniform characteristics and features, which may help create a table top with generally uniform properties such as strength and structural integrity. In addition, because a hollow interior portion may be formed during the blow-molding process, that may facilitate construction of a lightweight table top. Thus, the blow-molded plastic table top may be both lightweight and strong. The table top could also be formed from other suitable processes, such as injection, rotational, extrusion, vacuum or thermoforming processes, and the table top could be constructed using other appropriate materials such as steel, aluminum, composites and the like Yet another aspect is a table that may include a frame attached to the table top. The frame may be sized and configured to allow the table top to be moved between folded and unfolded positions. For example, the frame may include rails, such as side rails, connected to the first and second sections of the table top, and the side rails may be pivotally connected by one or more hinge assemblies. In particular, a first portion of the side rail may be connected to the first section of the table top and a second portion of the side rail may be connected to the second section of the table top. The hinge assembly may be connected to the first and second portions of the side rail, which may allow a strong and sturdy table top to be constructed.

Still yet another aspect is a folding table that may include a locking mechanism which secures the table in a fixed position. In particular, the table may include a locking mechanism that locks the table top in the unfolded or use position. The locking mechanism may include a locking member movable between locked and unlocked positions. Advantageously, the locking mechanism may simply and quickly lock the table top in a fixed position.

A further aspect is a fold-in-half table that may include a table top with a first section and a second section that are connected by one or more hinge assemblies. In particular, a frame may be connected to the first and second sections of the table top, and the hinge assemblies may be connected to the frame. The hinge assemblies may be interconnected by a cross member that extends across a width of the table top. The cross member and a support structure may be connected by a cross brace and movement of the support structure may cause the cross member to move. In particular, the movement of the support structure may cause the cross member to rotate. The rotation of the cross member may lock and unlock the locking mechanism. For example, a first gear may be connected to the cross member and it may engage a second gear which is connected to a locking member that is movable between locked and unlocked positions. When the locking member is in the locked position, it may prevent one or both of the hinge assemblies from rotating, which may lock the table top in a fixed position. Thus, movement of a support structure from the collapsed to the extended position may cause the table top to be locked in the unfolded position. On the other hand, when the support structure is moved from the extended to the collapsed position, this may unlock the locking mechanism and allow the table top to be folded.

A still further aspect is a table that may include a foldable table top and foldable legs which can be manufactured quickly and easily. In particular, the table may include relatively few components and the components may be quickly and easily assembled. Further, the straightforward design and attachment of the components may allow the table to be shipped either assembled or unassembled, and it may allow retailers or consumers to assemble the table if desired.

Another aspect is a folding table that may include a table top with a first portion and a second portion that are movable between a folded position and an unfolded position. The table may include a frame with a first portion connected to the first portion of the table top and a second portion connected to the second portion of the table top. The table may also include a hinge assembly connecting the first portion of the frame and the second portion of the frame. In addition, the table may include a support structure movable between an extended position and a collapsed position relative to the first portion of the table top. The table may additionally include a cross member disposed at least proximate a center portion of the table top and the cross member may be movable between a first position and a second position. The table may further include a cross brace coupled to the support structure and the cross member, and the cross brace may be movable between an extended position and a collapsed position. The table may still further include a locking mechanism with a locked position, which may secure the hinge assembly in a fixed position, and an unlocked position. Advantageously, the movement of the support structure between the extended and collapsed positions may lock and unlock the locking mechanism. Additionally, when the support structure is in the extended position and the locking mechanism is in the locked position, the table top may be secured in the unfolded position.

Still another aspect is a folding table may include one or more gears to rotationally connect the cross member and the locking mechanism. Thus, rotation of the cross member may lock and unlock the locking mechanism.

Yet another aspect is a folding table may include a cross brace connected to a cross member in a fixed position so that movement of the cross brace between the extended and collapsed positions causes rotation of the cross member. In addition, the cross member may be rotationally coupled to the locking mechanism so that rotation of the cross member locks and unlocks the locking mechanism.

Still yet another aspect is a folding table in which the movement of the support structure from the collapsed position to the extended position may cause the cross brace to move from the collapsed position to the extended position; and the movement of the cross brace from the collapsed position to the extended position may cause the cross member to move from the first position to the second position. Advantageously, movement of cross member between the first and second positions may lock and unlock the locking mechanism.

A further aspect is a folding table in which the movement of the support structure from the collapsed position to the extended position may cause the following to occur: the cross brace may move from the collapsed position to the extended position, the cross member may rotate from the first position to the second position, one or more gears may rotate from a first position to a second position, and the locking mechanism may move from the unlocked position to the locked position to secure the table top in the unfolded position.

A still further aspect is a folding table in which the cross member may be rotatably connected to the hinge assembly. The cross member may also be aligned with an axis of rotation of the table top between the folded and unfolded positions. The cross member may also rotate between the first position and the second position. In addition, the cross member may be rotatably coupled to the locking mechanism. Further, the rotation of the cross member locks and unlocks the locking mechanism.

Another further aspect is a folding table may include one or more gears connecting the cross member and the locking mechanism. Additionally, the locking mechanism may include a locking member movable between a locked position and an unlocked position. The locking mechanism may also include one or more flanges and the one or more gears may be disposed at least proximate or between the flanges of the locking mechanism. For instance, the locking mechanism may include two or more flanges and the one or more gears may be at least substantially disposed between the flanges of the locking mechanism.

Yet another further aspect is a folding table that may include a support structure receiving portion in a body of a cross brace sized and configured to receive a portion of the support structure when the support structure and the cross brace are in the collapsed positions. The folding table may further include a first receiving potion, which may be integrally formed in the lower surface of the table top as part of a unitary, one-piece construction, sized and configured to receive an elongated body of the cross brace when the cross brace is in the collapsed position; and a second receiving portion, which may be integrally formed in the lower surface of the table top as part of the unitary, one-piece construction, sized and configured to receive the support structure receiving portion of the cross brace when the cross brace is in the collapsed position.

Still yet another further aspect is a folding table that may include a support structure receiving portion in the cross brace sized and configured to receive a portion of the support structure when the support structure and the cross brace are in the collapsed positions, the portion of the support structure disposed in the receiving portion may be generally aligned with an axis extending through a body of the cross brace. The folding table may further include a first plurality of engagement members connected to the cross member, the first plurality of engagement members may be sized and configured to engage a second plurality of engagement members, the second plurality of engagement members may be connected to the locking mechanism. The first plurality of engagement members may be sized and configured to move the second plurality of engagement members, which may move the locking mechanism between the locked and unlocked positions. The folding table may also include a first gear connected to the cross member, a second gear engaging the first gear, and a locking member connected to the second gear. The rotation of the first gear may rotate the second gear, which may lock or unlock the locking mechanism.

Another aspect is a method of securing a folding table in a locked position or an unlocked position by moving a support structure between collapsed and extended positions. For instance, the folding table may include a table top with a first portion and a second portion movable between a folded position and an unfolded position, a hinge assembly may connect the first portion of the table top and the second portion of the table top, a support structure may be movable between an extended position and a collapsed position relative to the first portion of the table top, a cross member may be movable between a first position and a second position, a cross brace may be coupled to the support structure and the cross member, and a locking mechanism may include a locked position in which the hinge assembly is secured in a fixed position and an unlocked position. The method may include disposing the folding table with the table top in the unfolded position and the support structure in the collapsed position. The method may further include moving the support structure from the collapsed position to the extended position, which may cause the cross brace to move from the collapsed position to the extended position, and the cross member to move from the first position to the second position, which may cause the locking mechanism to move from the unlocked position to the locked position. Advantageously, when the support structure is in the extended position and the locking mechanism is in the locked position, the table top may be secured in the unfolded position.

Still another aspect is a folding table that may include a table top comprising a first portion and a second portion, the table top movable between a folded position and an unfolded position; a frame comprising a first portion connected to the first portion of the table top and a second portion connected to the second portion of the table top; a hinge assembly connecting the first portion of the frame and the second portion of the frame; a support structure movable between an extended position and a collapsed position relative to the first portion of the table top; a cross member connected to the hinge assembly, the cross member rotatable between a first position and a second position; a cross brace coupled to the support structure and the cross member, the cross brace movable between an extended position and a collapsed position; and a locking mechanism rotatably coupled to the cross member, the locking mechanism including a locked position and an unlocked position. The movement of the support structure between the extended and collapsed positions may cause the locking mechanism to move between the locked and unlocked positions, and when the support structure is in the extended position and the locking mechanism is in the locked position, the table top may be secured in the unfolded position. In addition, at least a portion of a first gear may be connected to the cross member, a second gear may be connected to the first gear, and a locking member may be connected to the second gear. The rotational movement of the cross member between the first and second positions may cause the first and second gears to rotate, which may move the locking member between the locked and unlocked positions.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is directed towards folding tables. The principles of the present invention, however, are not limited to folding tables. It will be understood that, in light of the present disclosure, the tables disclosed herein can be successfully used in connection with other types of tables, furniture and the like.

Additionally, to assist in the description of the tables, words such as top, bottom, front, rear, right and left may be used to describe the accompanying figures. It will be appreciated the tables can be disposed in other positions, used in a variety of situations and may perform a number of different functions. In addition, the drawings may be to scale and may illustrate various configurations, arrangements, aspects and features of the table. It will be appreciated, however, the table may have other suitable shapes, sizes, configurations and arrangements depending, for example, upon the intended use of the table. Further, the table may include any suitable number or combination of aspects, features and the like. A detailed description of exemplary embodiments of the tables now follows.

Figure 1:
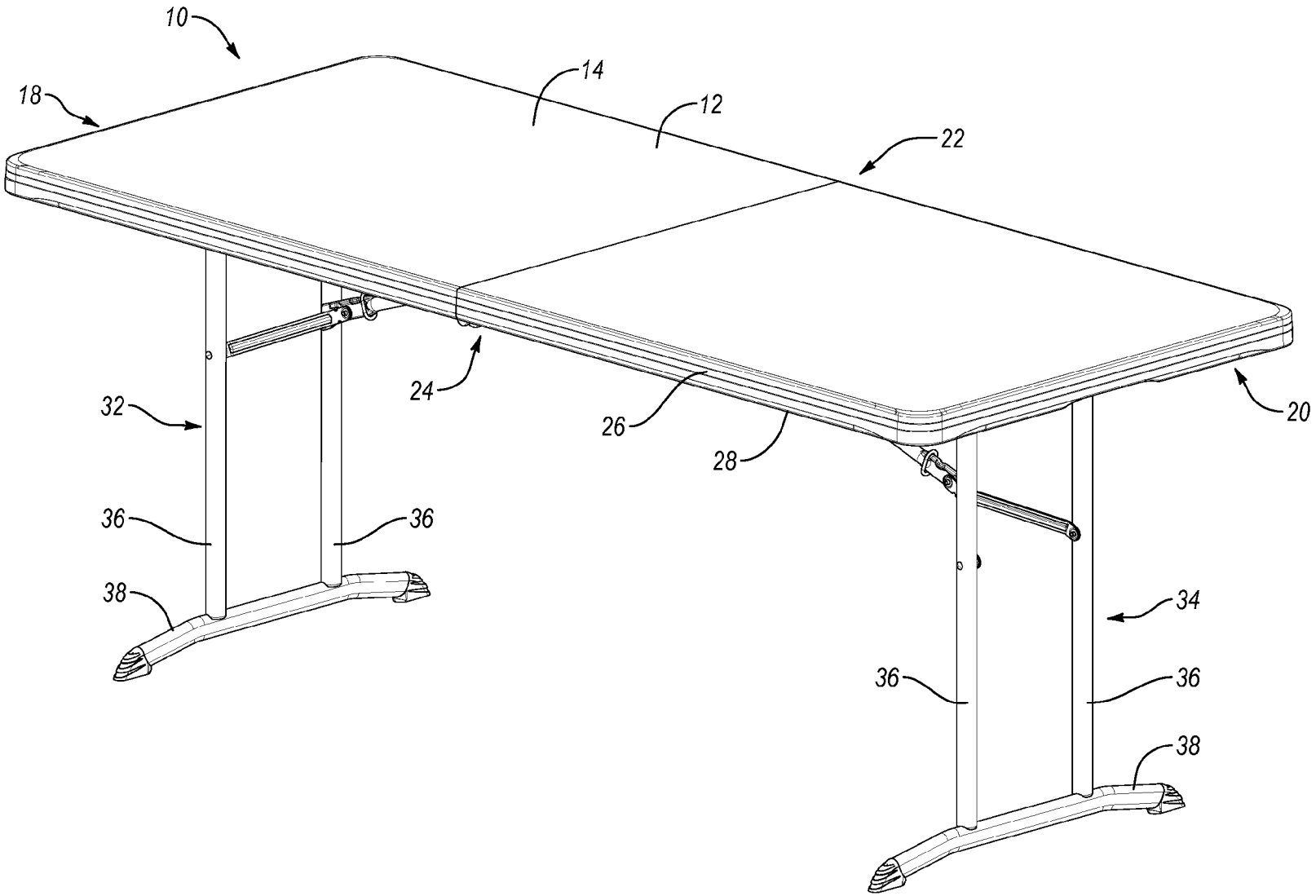
FIG. 1 is an upper perspective view of an exemplary table.

As shown in FIG. 1, the table 10 may include a table top 12 with an upper portion or surface 14, a lower portion or surface 16, a first end 18, a second end 20, a first side 22 and a second side 24. The upper surface 14 of the table top 12 is preferably generally planar to create a working surface, but the upper surface could also be textured and have other suitable configurations depending, for example, upon the intended use of the table. The table top 12 may also include an edge 26 that is disposed about the outer perimeter or periphery of the table top. All or a portion of the edge 26 may be beveled, sloped or rounded to, for example, increase the comfort and safety of the user. The table top 12 may also include a downwardly extending lip 28 disposed near or at least proximate an outer portion or perimeter of the table top. The lip 28 preferably extends downwardly relative to the lower surface 16 of the table top 12 and the lip may be aligned with or form a part of the edge 26 of the table top. It will be appreciated that the lip 28 may also be spaced inwardly from the edge 26 of the table top 12. It will also be appreciated that the table 10 and its various components may have other shapes, sizes, configurations and arrangements, such as disclosed in U.S. Pat. Nos. 6,530,331; 7,111,563; 7,475,643; 7,814,844; and 7,975,625; each of which are incorporated by reference in its entirety. It will further be appreciated that the table 10 may also include any suitable number of features and aspects depending, for example, upon the intended use of the table.

As shown in the accompanying figures, the table top 12 may have a generally rectangular configuration with rounded corners. The table top 12 may have a relatively large size and the table 10 may be configured for use as a banquet or utility table. For example, the table top 12 may have a length of about five feet (or about sixty inches) and a width of about two and one-half feet (or about thirty inches), but the table top could be larger or smaller. For instance, the table top 12 could be six to ten feet in length, and the table top could be two to three feet in width. One skilled in the art will appreciate the table top 12 could be larger or smaller; may have other suitable shapes and configurations such as square, circular, oval and the like; and the sides, corners, edges and other portions of the table top could have various shapes, sizes, configurations and arrangements depending, for example, upon the intended use of the table 10. Further, the table 10 could be any suitable type of table such as a folding table, non-folding table, card table, personal table, round table and the like.

The table top 12 may be constructed from lightweight materials such as plastic. In particular, the table top 12 may be constructed from materials such as high-density polyethylene but other suitable materials can be used. The table top 12 may be constructed from blow-molded plastic which may allow a relatively strong, lightweight, rigid and sturdy table top to be quickly and easily manufactured. The blow-molded plastic table top 12 may be lightweight because it may include a hollow interior portion formed during the blow-molding process. The blow-molded plastic table top 12 may also be relatively durable, weather resistant, temperature insensitive, corrosion resistant, rust resistant and may not deteriorate over time. One of ordinary skill in the art will appreciate the table top 12 does not have to be constructed from blow-molded plastic and other suitable materials and/or processes can be used to construct the table top. For example, the table top 12 may be constructed from other types of plastics, polymers and synthetic materials; and different processes such as injection molding, rotational molding, rotary molding, etc. In addition, the table top 12 may be constructed from other materials with sufficient strength and desirable characteristics such as wood, metal, alloys, composites, fiberglass, ceramics and the like.

Figure 2:
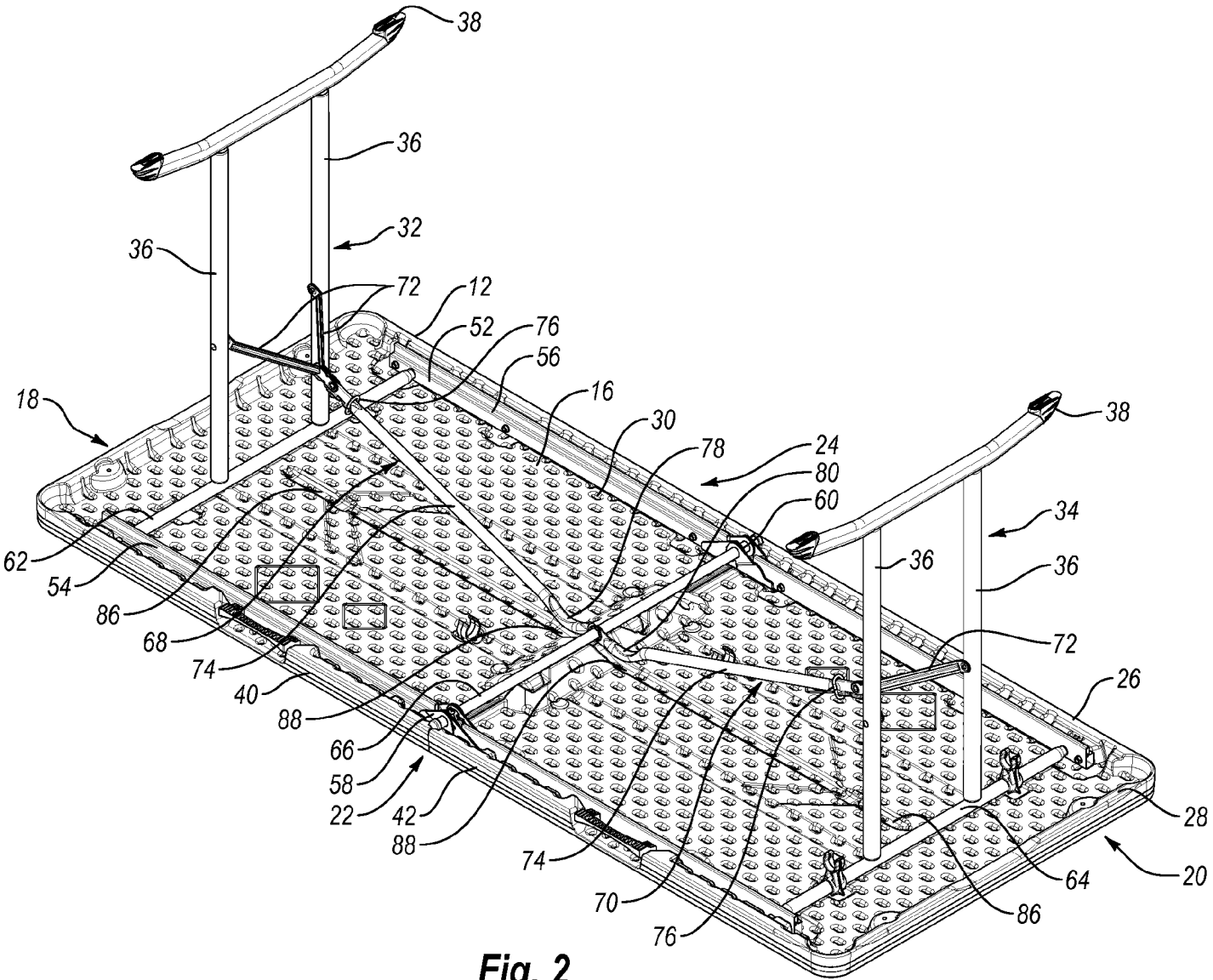
FIG. 2 is a lower perspective view of the table, illustrating the support structures and cross braces in extended positions.
Figure 3:
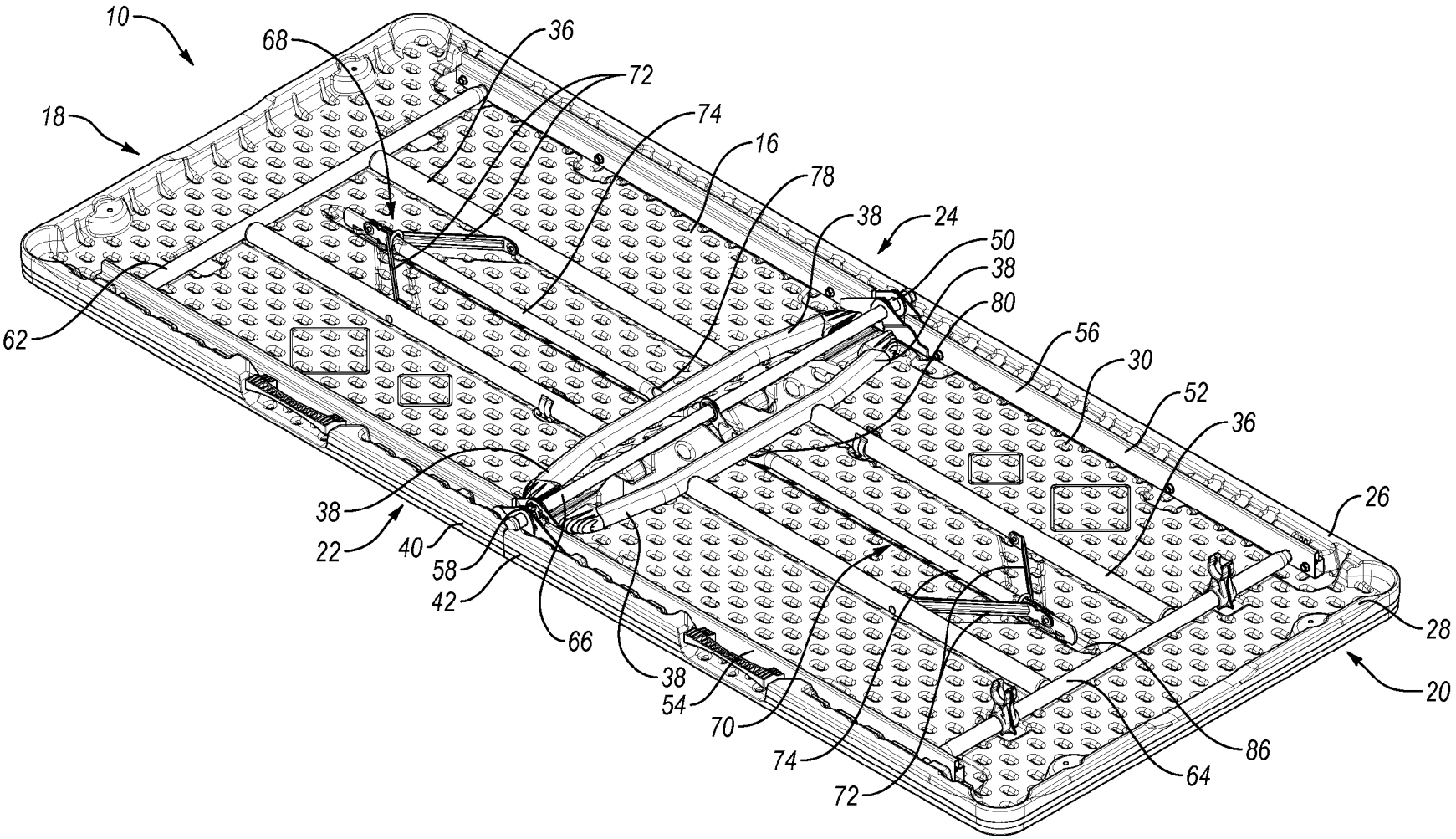
FIG. 3 is another lower perspective view of the table, illustrating the support structures and cross braces in collapsed positions.

The table top 12 may include spaced apart outer walls, such as the upper and lower surfaces 14, 16, which may help create a strong and rigid table top. For instance, the upper and lower surfaces 14, 16 of the table top 12 may be separated by a generally constant distance and the surfaces may be generally aligned in parallel planes. As shown in FIGS. 2 and 3, for example, the table top 12 may also include one or more tack-offs, kiss-offs or depressions 30. The depressions 30 may be disposed in the lower surface 16 of the table top 12 and the depressions may be sized and configured to increase the strength and/or rigidity of the table top. The depressions 30 may also be used to create a table top 12 with more uniform properties and characteristics, and the depressions may cover a majority, substantially all or the entire lower surface 16 of the table top. Advantageously, the depressions 30 can be integrally formed with the table top 12 as part of a unitary, one-piece construction or structure, and the depressions may be formed in any desired portions of the table top. The depressions 30, and other portions of the table 10, may have other shapes, sizes, configurations, arrangements and features, such as disclosed in U.S. Pat. Nos. 7,069,865; 7,114,453; 7,143,702; and 7,210,277; and U.S. patent publication no. 2006-0230989; which are each incorporated by reference in its entirety.

The table 10 may include one or more support structures sized and configured to support the table top 12 above a surface. For example, the table 10 may include a first support structure 32 and a second support structure 34, and each support structure may include one or more legs or supports 36, and the legs may be connected by a connecting member or foot 38. The support structures 32, 34 may be movable between an extended or use position in which the legs 36 extend outwardly from the table top 12 and a collapsed or storage position in which the legs are disposed at least proximate the table top. The table 10 may include any suitable number, shape, size, configuration and arrangement of support structures 32, 34; legs 36; and/or feet 38 depending, for example, upon the intended use of the table.

Figure 4:
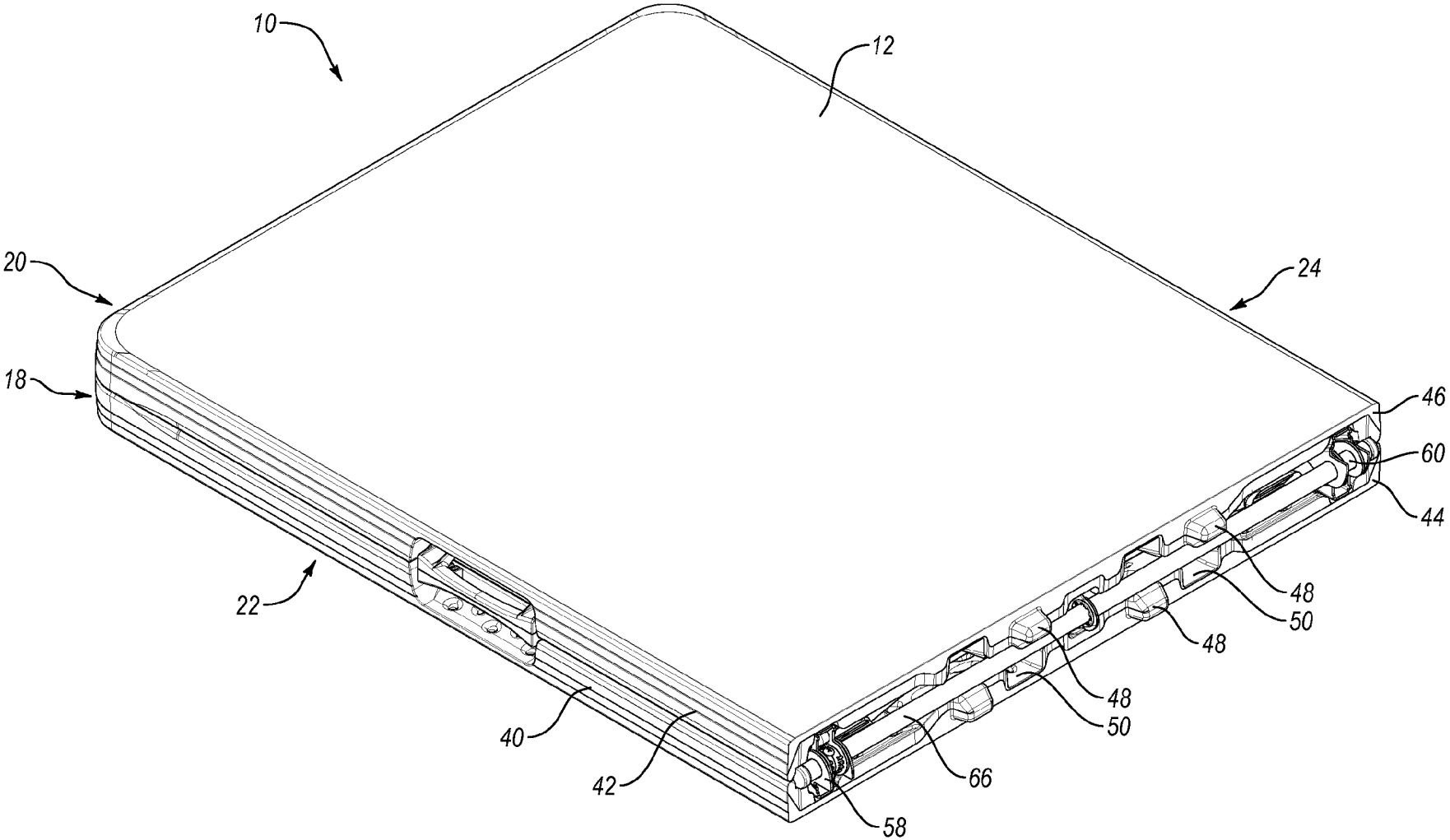
FIG. 4 is an upper perspective view of the table, illustrating the table in a folded position.

As seen in FIG. 4, the table 10 may be a fold-in-half table and the table top 12 may include a first section 40 and a second section 42. As shown in the accompanying figures, the first support structure 32 may be movable between the extended and collapsed positions relative to the first section 40 of the table top 12. The second support structure 34 may be movable between the extended and collapsed positions relative to the second section 42 of the table top 12. In addition, the first and second sections 40, 42 of the table top 12 may be foldable about an axis between an unfolded position and a folded position. The first and second sections 40, 42 may be generally aligned in the same plane when the table top 12 is in the unfolded position, and the first and second table top sections may be disposed generally adjacent and parallel to each other when the table top is in the folded position.

As shown in the accompanying figures, the first and second sections 40, 42 of the table top 12 may have a generally rectangular configuration with a symmetrical or mirror-image configuration. In addition, the first section 40 of the table top 12 may include an inner surface 44 that is sized and configured to contact and/or engage an inner surface 46 of the second section 42 of the table top when the table 10 is in the unfolded position. The inner surfaces 44, 46 may then be spaced apart when the table top 12 is in the folded position. The inner surfaces 44, 46 of the table top 12 may include one or more interlocking, overlapping and/or intertwined portions, such as an engaging portion 48 and a receiving potion 50 shown in FIG. 4, which may provide additional strength, stability and/or rigidity to at least the center portion of the table top. The table top 12 may also have other shapes, sizes, configurations and arrangements, such as shown in U.S. Pat. No. 7,096,799, which is incorporated by reference in its entirety.

As seen in FIGS. 2 and 3, for example, the table 10 may include a frame 52 connected to the table top 12 and the frame may include one or more elongated members or rails. In particular, a first side rail 54 may be disposed at least proximate the first side 22 of the table top 12 and this side rail may include a first portion connected to the first section 40 of the table top and a second portion connected to the second section 42 of the table top. A second side rail 56 may be disposed at least proximate the second side 24 of the table top 12 and this side rail may include a first portion connected to the first section 40 of the table top and a second portion connected to the second section 42 of the table top. While the side rails 54, 56 may be positioned at least proximate the sides 22, 24 of the table top 12 and may extend almost the entire length of the first and second portions 40, 42 of the table top 12, the side rails and/or the frame 52 may have other shapes, sizes, configurations and arrangements depending, for example, upon the intended use of the table 10. For example, the frame 52; side rails 54, 56 or table 10 could include one or more features or aspects as disclosed in U.S. patent application Ser. No. 13/559,062, filed Jul. 26, 2012, entitled Frame for a Folding Table, which is each incorporated by reference in its entirety.

The first and second side rails 54, 56 of the frame 52 may be pivotally connected by first and second hinge assemblies 58, 60, respectively, to allow the table 10 to be moved between the folded and unfolded positions. In particular, the first hinge assembly 58 may be connected to the first side rail 54 and the second hinge assembly 60 may be connected to the second side rail 56. The first and second hinge assemblies 58, 60 may allow the first and second sections 40, 42 of the table top 12 to rotate about an axis of rotation when the table is folded and unfolded.

The frame 52 and the first support structure 32 may be connected by a first cross member 62, and the frame and the second support structure 34 may be connected by a second cross member 64. For example, the ends of the first and second cross members 62, 64 may be disposed in openings in the side rails 54, 56 of the frame 52 to allow the cross members to rotate relative to the frame. The cross members 62, 64 may also be connected to the frame 52, and the table 10 may include other features, such as shown in U.S. Pat. No. 7,100,518, which is incorporated by reference in its entirety. Advantageously, the cross members 62, 64 may form part of the frame 52 and/or the support structures 32, 34, depending, for example, upon the particular arrangement and/or configuration of the table 10.

A cross member 66 may be disposed at least proximate a center portion of the table top 12. The cross member 66 may be aligned with the axis of rotation of the table 10 between the folded and unfolded positions, and the cross member may be connected to the hinge assemblies 58, 60. As described in greater detail below, the cross member 66 may be rotatably coupled to the hinge assemblies 58, 60. This may allow the cross member 66 to rotate between one or more positions, such as a first position and a second position. The cross member 66 could also be connected to other suitable portions of the table 10. In addition, the cross member 66 may be disposed in a fixed position relative to the table top 12 or it may move relative to the table top, and the cross member may also be disposed in one or more receiving portions. These and other features that may be used in connection with the table 10 are disclosed in U.S. patent publication no. 2011/0203493, entitled TABLE, which was filed on Feb. 2, 2011; and U.S. patent publication no. 2011/0203494, entitled TABLE, which was filed on Feb. 2, 2011, which are each incorporated by reference in its entirety.

As best seen in FIGS. 2 and 3, a first cross brace 68 may be connected the cross member 66 and the first support structure 32, and a second cross brace 70 may be connected the cross member 66 and the second support structure 34. The first and second cross braces 68, 70 may include a pair of arms 72 pivotally connected to the legs 36 and an elongated body 74 connected to the cross member 66. The arms 72 and the elongated body 74 may be pivotally connected and a locking member, such as a locking ring 76, may be used to secure the cross braces 68, 70 in an extended position.

Figure 5:
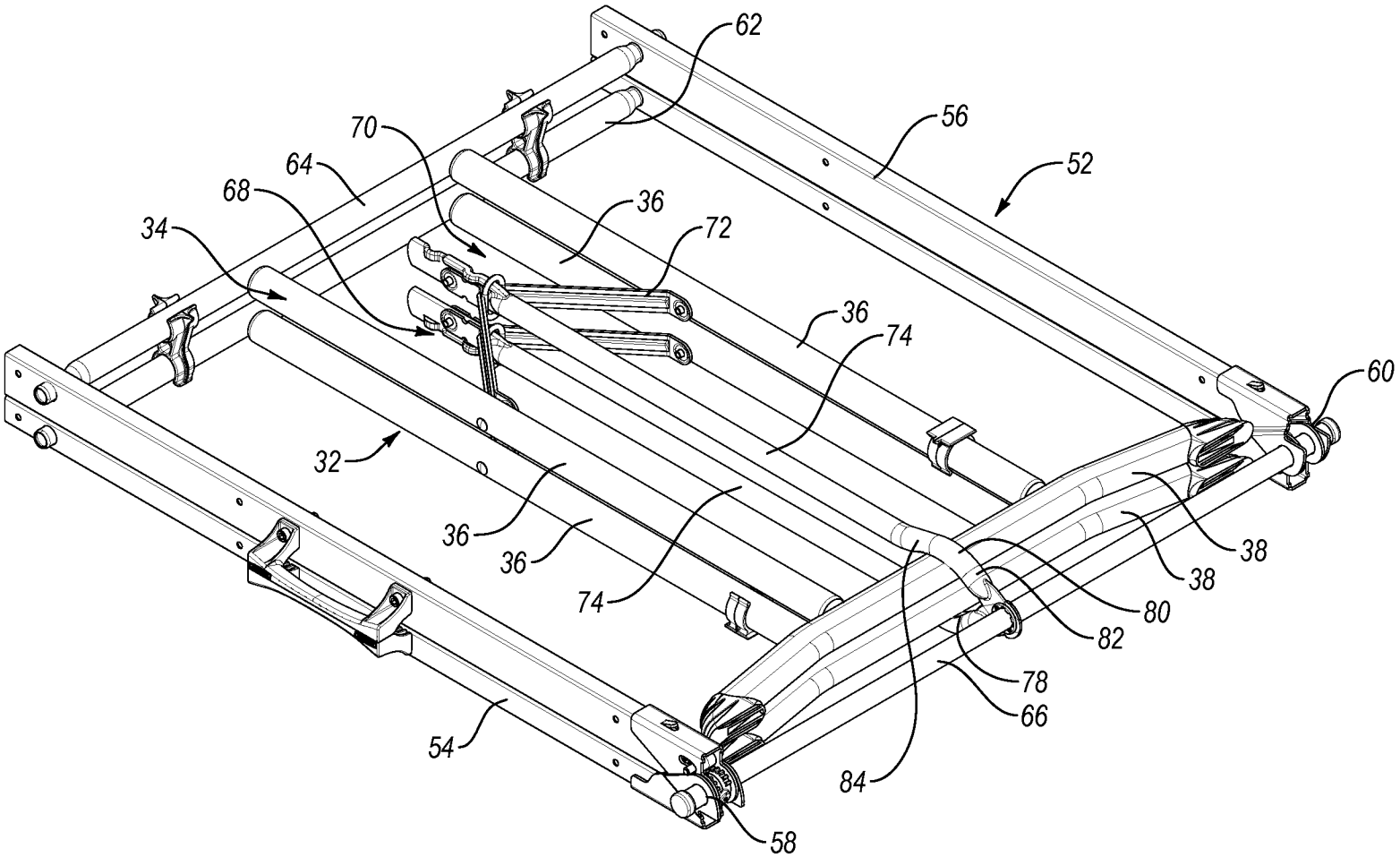
FIG. 5 is an upper perspective view of a portion of the table, illustrating the frame in a folded position.

The body 74 of the cross braces 68, 70 may include one or more curved, bent or angled sections, which may facilitate folding of the table 10. For example, as shown in FIGS. 2, 3 and 5-9, the first cross brace 68 may include a first foot receiving portion 78 and the second cross brace 70 may include a second foot receiving portion 80. As shown in FIGS. 5 and 9, when the table 10 is folded, the feet 38 may be disposed in the foot receiving portions 78, 80. In addition, as shown in FIG. 3, when the support structures 32, 34 are in the collapsed positions, the feet 38 may be aligned with the body 74 of the cross braces 68, 70. In particular, the portion of the foot 38 disposed in the foot receiving portions 78, 80 may be generally aligned with an axis extending through the elongated body 74 of the cross braces 68, 70. Advantageously, this may allow the table 10 to have a compact size in the folded position.

In greater detail, the first and second foot receiving portions 78, 80 may include a first curved, bent or angled section 82 and a second curved, bent or angled section 84. The first curved portion 82 preferably extends towards the lower portion 16 of the table top 12 and the second curved portion 84 preferably extends away from the lower portion of the table top. The table top 12 may include a first receiving portion 86 that extends a first distance into the lower portion 16 of the table top. The first receiving portion 86 may be sized and configured to receive at least a portion of the body 74 of the cross braces 68, 70 when the support structures 32, 34 are in the collapsed position. The table top 12 may also include a second receiving portion 88 that extends a second distance into the table top and is sized and configured to receive the foot receiving portions 78, 80 when the support structures 32, 34 are in the collapsed position. The second receiving portion 88 may have a larger height and extend further into the lower portion 16 of the table top 12 than the first receiving portion 86 to accommodate the first and second foot receiving portions 78, 80.

As mentioned above, the elongated body 74 of the first and second cross braces 68, 70 may be connected to the cross member 66. For example, an end of the elongated body 74 may include an opening and the cross member 66 may be disposed in the opening. Preferably, one of the cross braces 68, 70 is connected to the cross member 66 such that movement of the cross brace causes movement of the cross member. For instance, the end of the second cross brace 70 may be secured to the cross member 66 such that movement of the second cross brace causes the cross member to rotate. Thus, the second cross brace 70 may be secured to the cross member 66 in a fixed position. The cross member 66, however, may freely rotate or pivot relative to the first cross brace 68. Therefore, movement of the second cross brace 70 may cause the cross member 66 to rotate but movement of the first cross brace 68 may not cause the cross member to rotate or move. It will be appreciated that either cross brace 68, 70 may be rotatably or non-rotatably connected to the cross member 66 and the cross braces may be connected to other portions of the table 10. The table 10 may also have other suitable arrangements and configurations such as two or more cross members and the cross braces 68, 70 may be connected to different cross members and/or other portions of the table top 12. In addition, it will be appreciated that the cross members 62, 64, 66 and cross braces 68, 70 may have other suitable shapes, sizes, configurations and arrangements depending, for example, upon the intended use of the table 10.

In greater detail, the second cross brace 70 may be connected to the cross member 66 such that movement of the second support structure 34 causes movement of the cross member. For instance, as the second support structure 34 is moved between the extended and collapsed positions, the second cross brace 70 may cause the cross member 66 to rotate. In particular, movement of the second support structure 34 from the collapsed to the extended position may cause the cross member 66 to rotate in a first direction, such as clockwise, and movement of the second support structure from the extended to the collapsed position may cause the cross member to rotate in a second direction, such as counterclockwise. The first cross brace 68, however, may be connected to the cross member 66 in a manner so that movement of the first support structure 32 does not cause movement of the cross member. It will be understood that either or both of the support structures 32, 34 may be used to move or rotate the cross member 66 depending, for example, upon the design or configuration of the table 10.

Figure 6A:
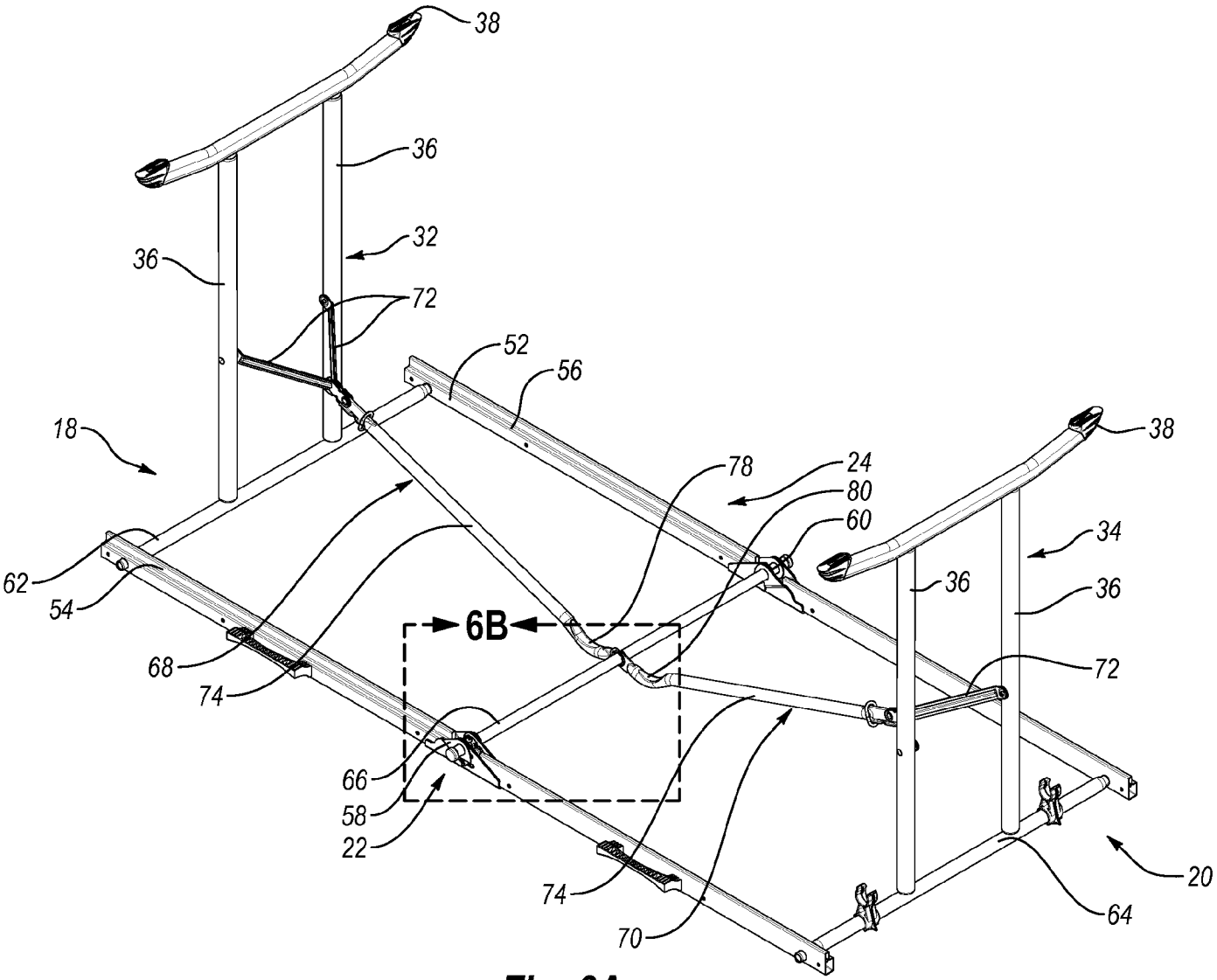
FIG. 6A is a perspective view of the frame shown in FIG. 5, illustrating the frame in an unfolded position.
Figure 6B:
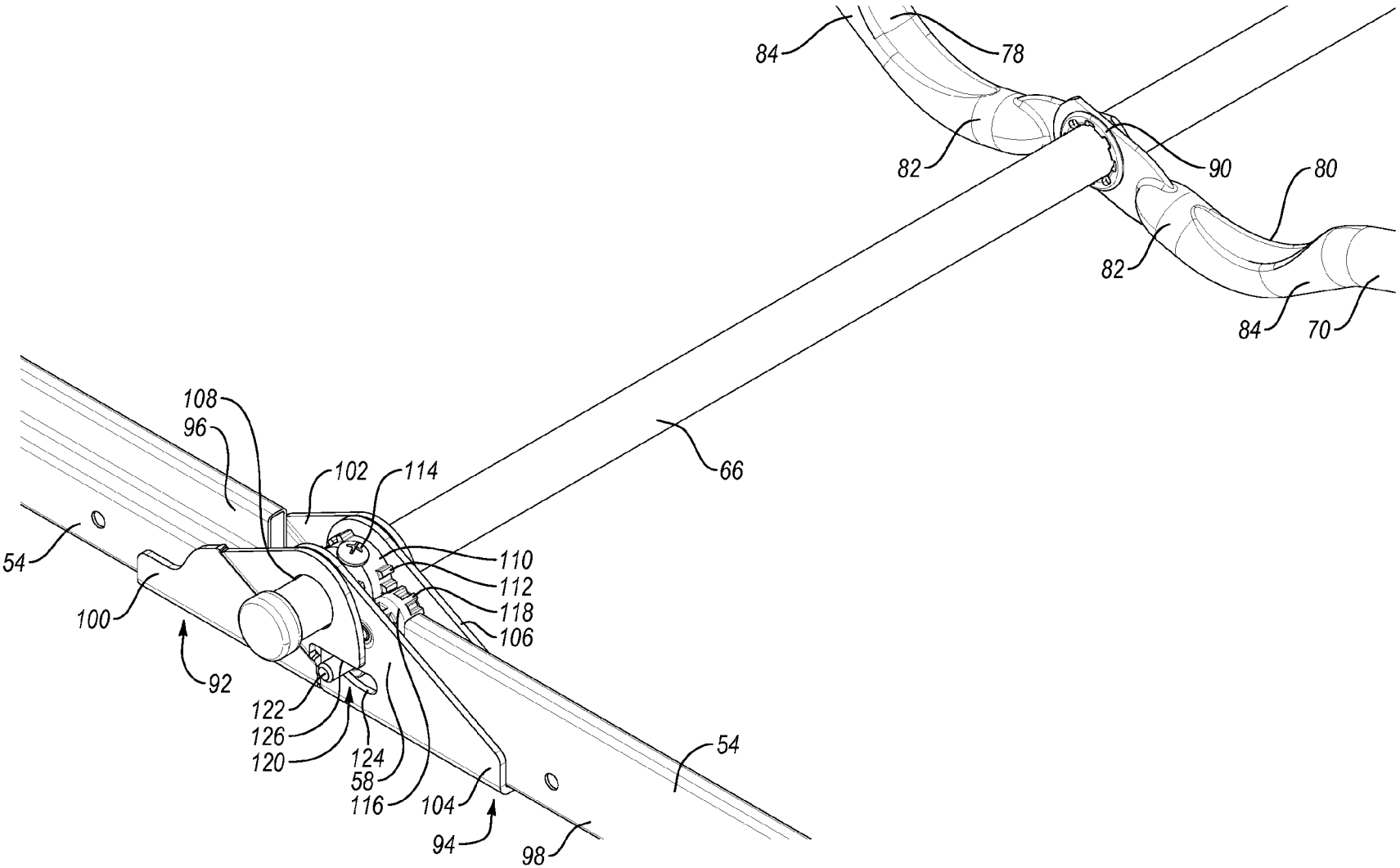
FIG. 6B is an enlarged perspective view of a portion of the frame shown in FIG. 6A, illustrating a locking mechanism in a locked position.

As shown in FIGS. 6A and 6B, the ends of the first and second cross braces 68, 70 connected to the cross member 66 may be disposed adjacent to each other and may be in contact. In addition, one or more sleeves 90 may be used to facilitate connection of the cross braces 68, 70 and the cross member 66. For example, the sleeve 90 may be used to connect the second cross brace 70 such that movement of the second support structure 34 causes movement of the cross member 66 and/or the sleeve may be used to allow the first support structure 32 to move without causing movement of the cross member. It will be appreciated that the cross member 66 and the cross braces 68, 70 may be connected in other suitable fashions such as by welding, adhesives, couplings, braces and the like. Further, as seen in FIG. 8, the first and second cross braces 68, 70 may be connected to the cross member 66 using other suitable structures, such as a connecting member, and the cross braces may be rotatably and/or non-rotatably attached to the connecting member.

The cross member 66 may be coupled to the hinge assemblies 58, 60 as shown in FIGS. 6A and 6B. In particular, the first hinge assembly 58 may include a first bracket 92 connected to a first portion 96 of the first side rail 54 and a second bracket 94 connected to a second portion 98 of the first side rail. The first bracket 92 may include a first pair of flanges 100, 102 and the second bracket 94 may include a second pair of flanges 104, 106. The end of the cross member 66 may be inserted through one or more apertures 108 in the flanges 100, 102, 104 and/or 106. Thus, the cross member 66 may pivotally connect the first and second brackets 92, 94 of the hinge assembly 58, the cross member may be rotatable relative to the brackets, the cross member may be aligned with an axis of rotation of the hinge assembly 58, and/or the table 10 may fold and unfold along this axis of rotation.

Figure 7:
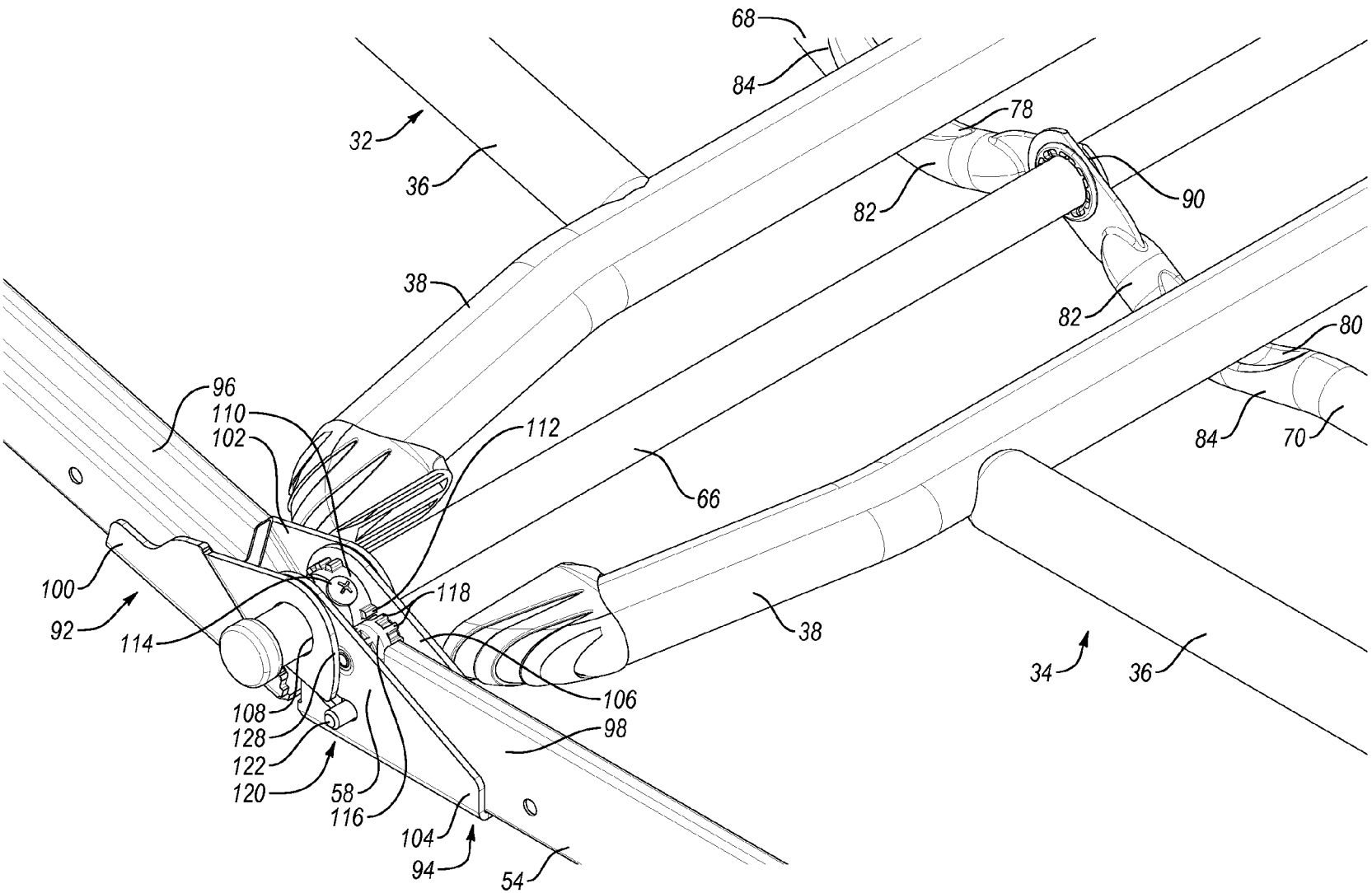
FIG. 7 is another perspective view of the portion of the table shown in FIG. 6A, illustrating the locking mechanism in an unlocked position and the frame in a partially folded position.
Figure 8:
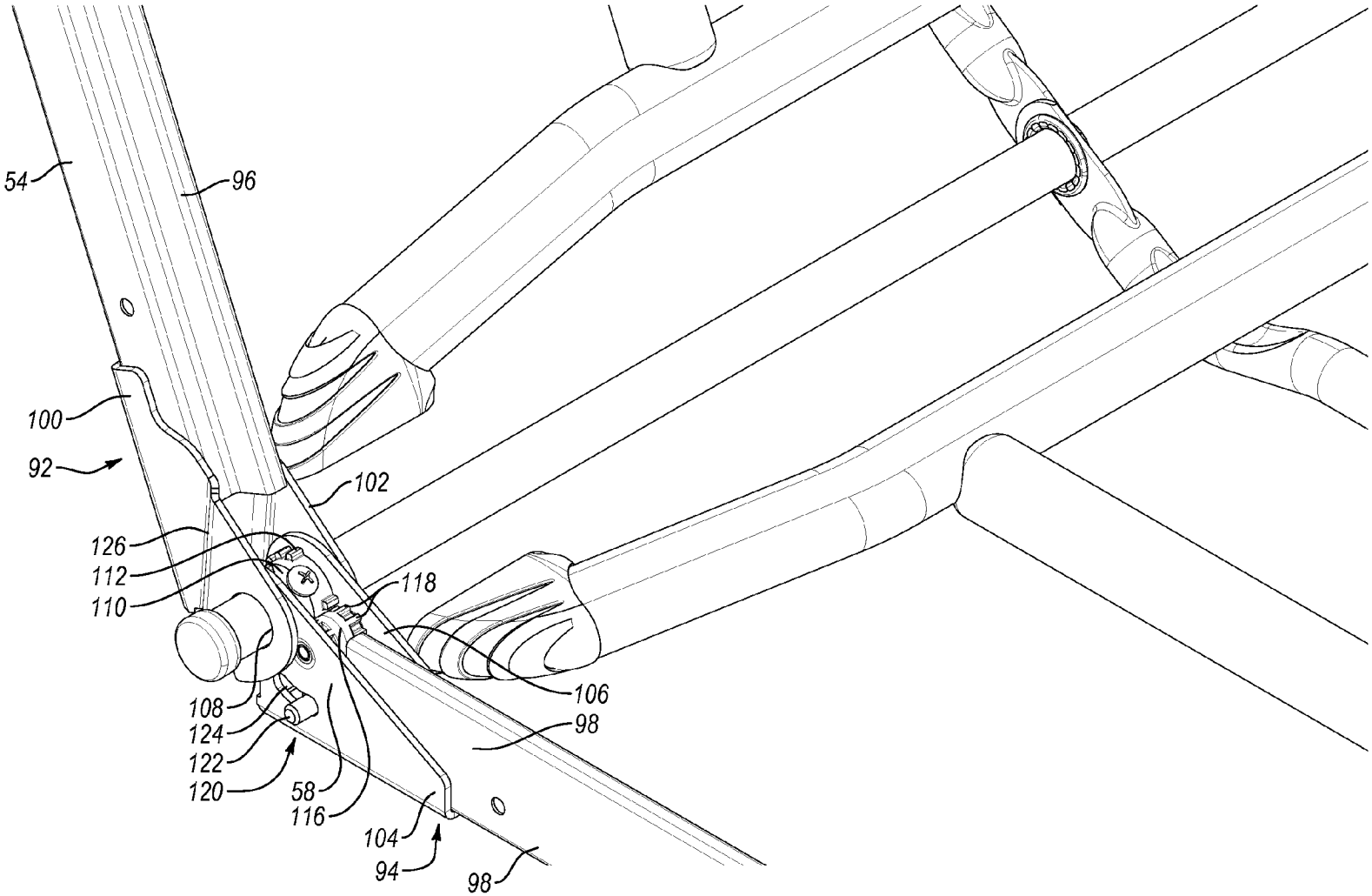
FIG. 8 is still another perspective view of the portion of the table shown in FIG. 6A, illustrating the locking mechanism in an unlocked position and the frame in another partially folded position.
Figure 9:
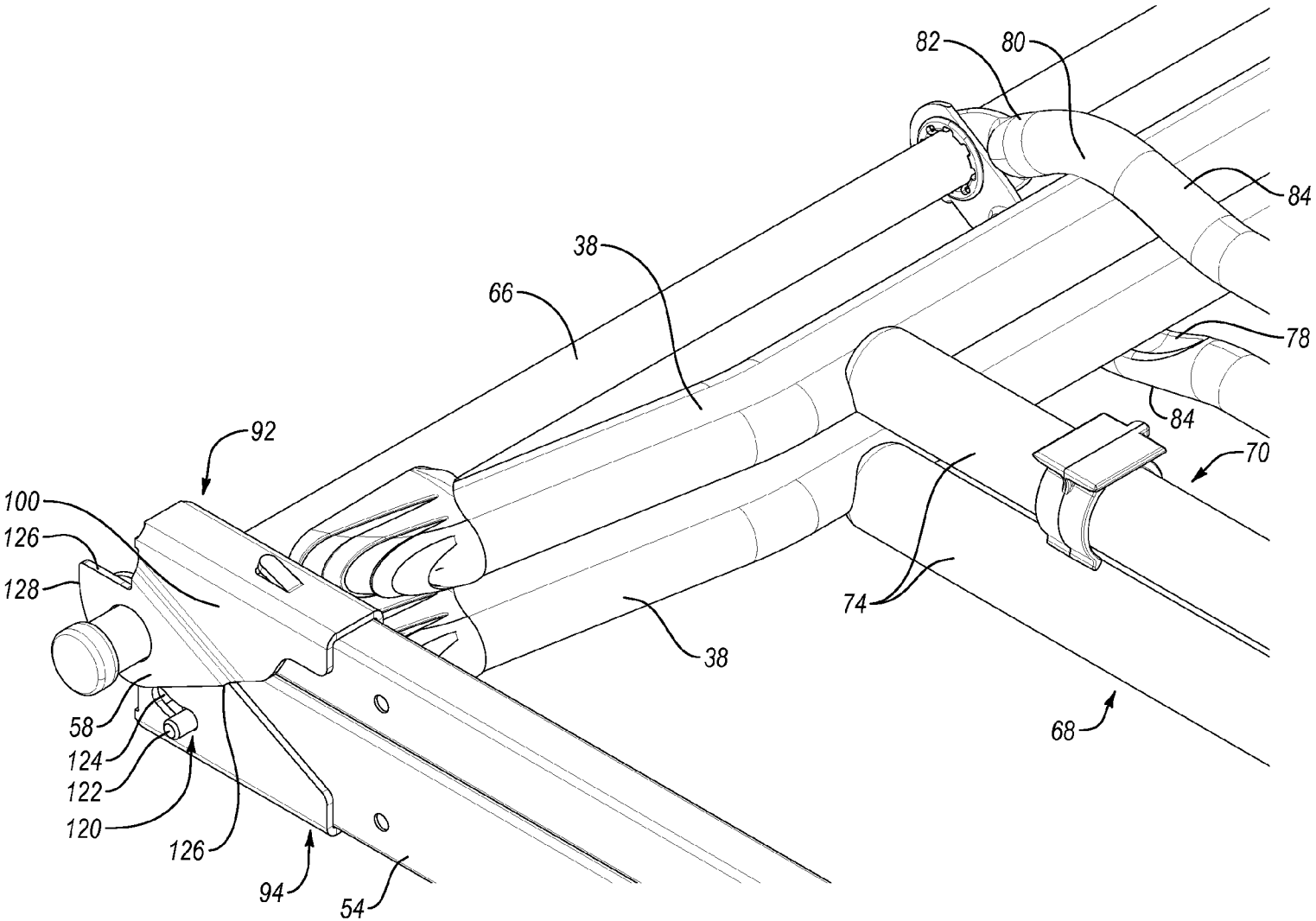
FIG. 9 is yet another perspective view of the portion of the table shown in FIG. 6A, illustrating the locking mechanism in an unlocked position and the frame in a folded position.

As shown in FIGS. 6-8, at least a portion of a first sprocket, cog or gear 110 with one or more projections or teeth 112 may be connected to the cross member 66 by means such as a fastener 114. The first gear 110 may be sized and configured to engage a second sprocket, cog or gear 116. In particular, the teeth 112 of the first gear 110 may engage one or more projections or teeth 118 of the second gear 116. Thus, when the cross member 66 rotates, the first gear 110 and the second gear 116 may also rotate. Advantageously, the first and second gears 110, 116 may be disposed between one or more of the flanges 100, 102, 104, 106 of the brackets 92, 94, which may help protect the gears from damage and/or position the gears relative to the cross member 66. It will be understood that any suitable number, size, shape, configuration and arrangement of gears may be used and the gears may be positioned in other desired locations.

The first and second gears 110, 116 may be connected to or form part of a locking mechanism 120, which may lock the table 10 and/or the table top 12 in a fixed position. In particular, the locking mechanism 120 may be sized and configured to lock the hinge assembly 58 in a fixed position, which may prevent folding of the table top 12. The locking mechanism may include a locking member 122 that is disposed within a slot 124. The locking member 122 may be moved between a first position in which the locking member locks the hinge assembly 58 and a second position in which the hinge assembly is unlocked. As shown in the accompanying figures, the locking member 122 may have a generally cylindrical configuration, which may facilitate movement between the locked and unlocked positions. The locking member 122 may also have other suitable shapes, sizes, configurations and arrangements depending, for example, upon the configuration of the hinge assembly 58.

In greater detail, the slot 124 may be disposed in the first flange 104 of the second bracket 94, and the first flange 100 of the first bracket 92 may include a receiving portion or engagement surface 126 and a curved or cam surface 128. The engagement surface 126 is preferably sized and configured to abut, contact or engage the locking member 122 when the locking member is in the locked position. The contact between the locking member 122 and the engagement surface 126 may prevent the hinge assembly 58 from closing or folding. The cam surface 128 may contact and/or be spaced apart from the locking member 122 when the locking member is in the unlocked position, which may allow the hinge assembly 58 to be opened or closed. In addition, the curved or cam surface 128 may help maintain the locking member 120 in the unlocked position, which may facilitate folding and unfolding the table 10 and/or the table top 12. Thus, when the locking member 122 of the locking mechanism 120 is in the locked position, it may contact the engagement surface 126 to prevent the hinge assembly 58 from closing. On the other hand, when the locking member 122 is in the unlocked position, it may not contact the engagement surface 126 and the hinge assembly 58 may be opened or closed. This may allow the table top 12 to be readily moved between the folded and unfolded configurations.

As shown in FIG. 6B, for example, the locking mechanism 120 may be in a locked position in which the locking member 122 engages the engagement surface 126 to secure the hinge assembly 58 in the open position. As shown in FIG. 7, when the locking mechanism 120 is in the unlocked position, the hinge assembly 58 may be closed and the locking member 122 may contact the cam surface 128. As shown in FIGS. 8 and 9, the locking member 122 may also be spaced apart from the cam surface 128 when the locking member is in the unlocked position and the hinge assembly 58 is being closed or is closed. The locking mechanism 120, the locking member 122, the slot 124, the engagement surface 126 and the cam surface 128 may also have other suitable shapes, sizes, configurations and arrangements depending, for example, upon the intended use of the table 10.

Advantageously, the interconnection of the support structures 32, 34; the cross braces 68, 70; the cross member 66 and the locking mechanism 120 may allow movement of the support structures to lock the table top 12 in the use position. In addition, movement of the support structures 32, 34 may unlock the table top 12 and allow the table top to be folded and unfolded. For example, moving the second support structure 34 from the collapsed to the extended position may cause the second cross brace 70 to move from the collapsed to the extended position, which may cause the cross member 66 to rotate, and that may rotate the first and second gears 110, 116 and move the locking member 122 within the slot 124 to the locked position. On the other hand, moving the second support structure 34 from the extended to the collapsed position may cause the second cross brace 70 to move from the extended to the collapsed position, which may rotate the cross member 66 and the gears 110, 116, and that may move the locking member 122 within the slot 124 into the unlocked position. This may beneficially allow locking and unlocking of the hinge assembly 58 to be controlled by movement of the support structures 32, 34.

In greater detail, as shown in FIGS. 6A and 6B, the cross member 66 may be disposed in a first position. When the cross member 66 is in the first position, the second support structure 34 may be in the extended position. As the second support structure 34 is moved from the extended to the collapsed position, the cross member 66 may rotate from the first position to a second position. For example, as shown in FIGS. 7 and 8, when the support structure 34 is in the collapsed position, the cross member 66 may be disposed in a second position. Advantageously, the rotation of the cross member 66 may rotate the first gear 110 in a first direction and the second gear 116 in a second direction, which may cause the locking member 122 to move within the slot 124 between the locked position shown in FIGS. 6A and 6B, and the unlocked position shown in FIGS. 7-9. Thus, when the support structure 34 is in the collapsed position, the locking mechanism 120 may be unlocked and the cross member 66 may be in the second position. When the support structure 34 is moved from the collapsed to the extended position, that may cause the cross member 66 to rotate from the second to the first position and move the locking mechanism 120 into the locked position. Consequently, movement of the support structure 34 may control rotation of the cross member 66 and locking of the locking mechanism 120, which may facilitate use of the table 10. It will be appreciated that movement of the table top 12 and/or the frame 52 between the folded and unfolded positions may also be used to lock and unlock the locking mechanism 120.

Figure 10:
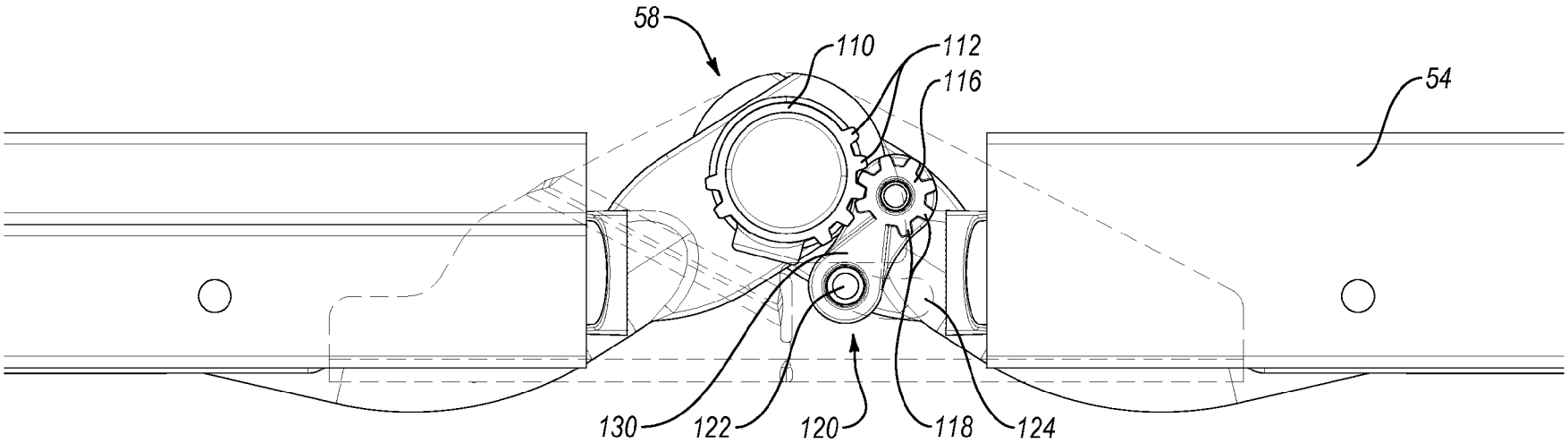
FIG. 10 is a side view of an exemplary locking mechanism, illustrating the locking mechanism in a first position and the frame in a first position.
Figure 11:
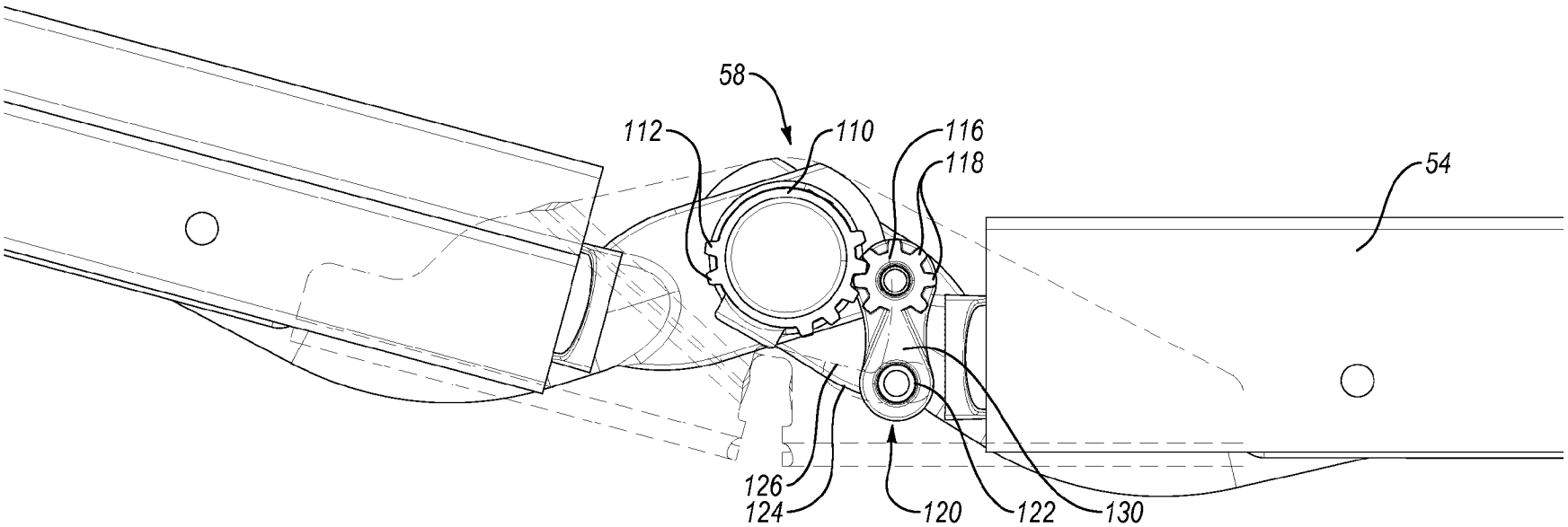
FIG. 11 is another side view of the locking mechanism shown in FIG. 10, illustrating the locking mechanism in a second position and the frame in a second position.
Figure 12:
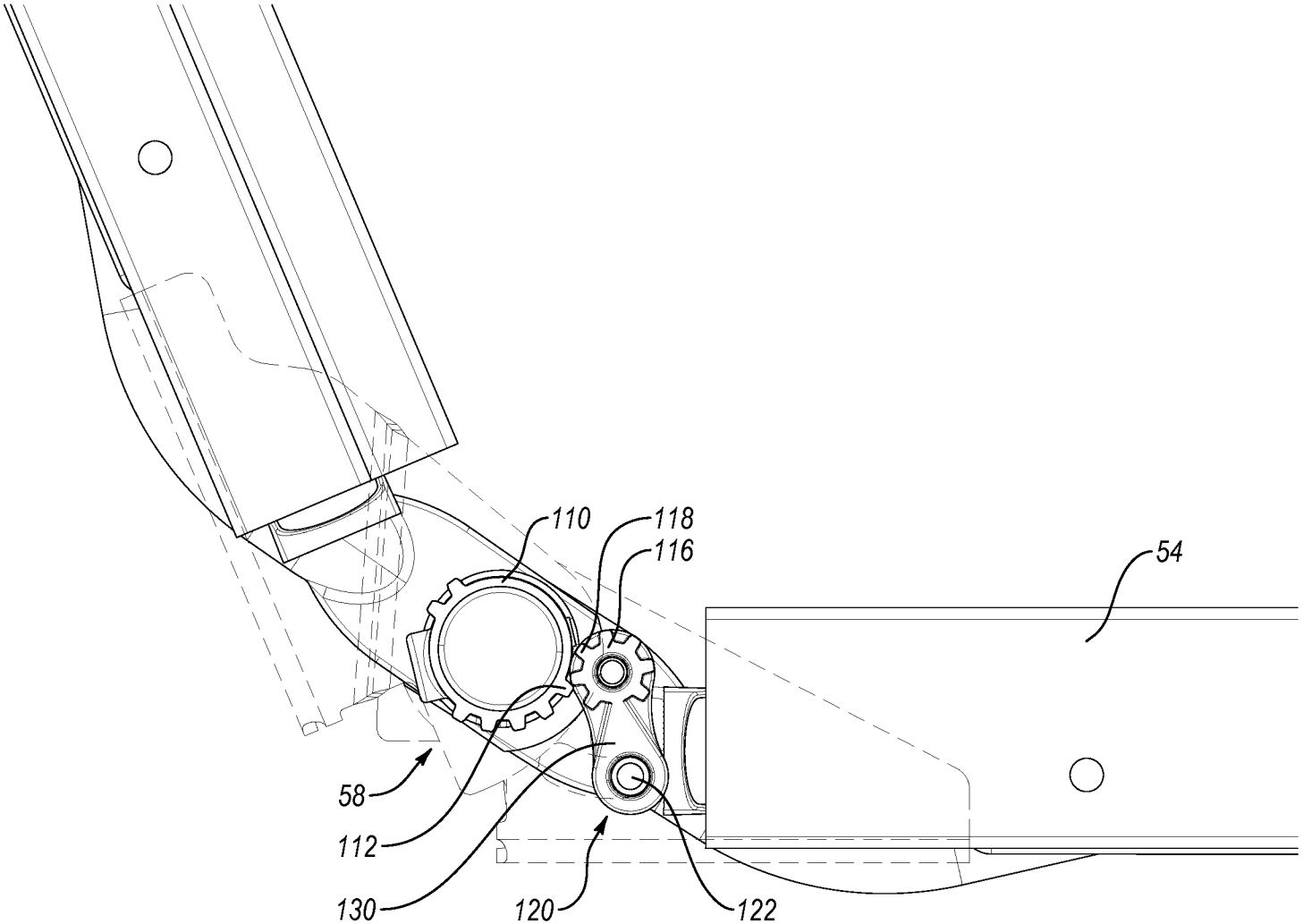
FIG. 12 is yet another side view of the locking mechanism shown in FIG. 10, illustrating the locking mechanism in the second position and the frame in the second position.
Figure 13:
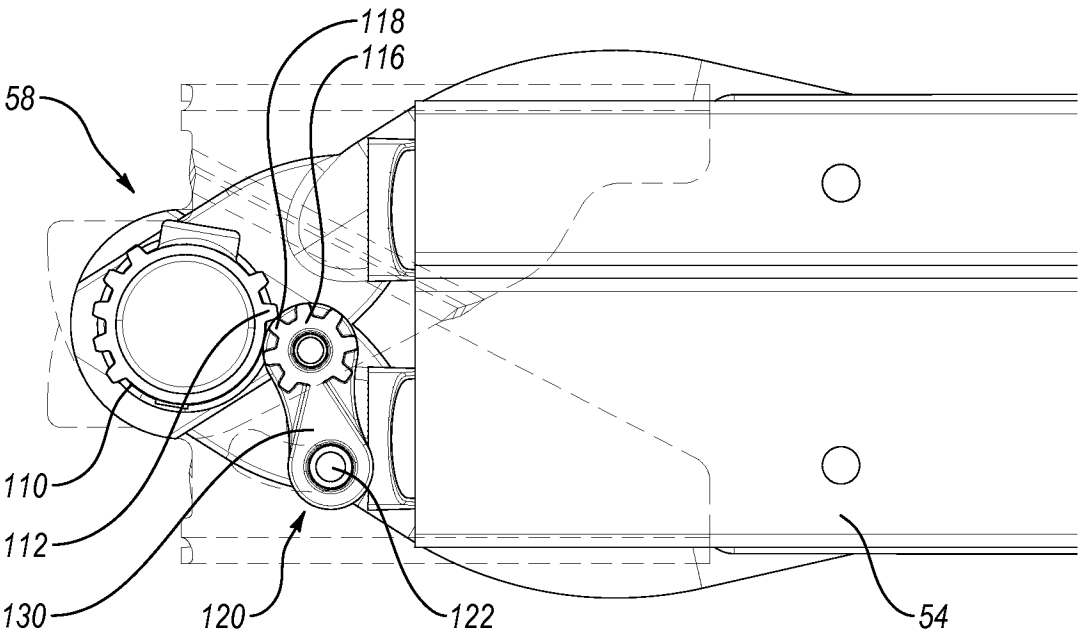
FIG. 13 is a further side view of the locking mechanism shown in FIG. 10, illustrating the locking mechanism in the second position and the frame in the folded position.

As shown in FIGS. 10-13, which illustrates an exemplary embodiment of the locking mechanism 120 in which the teeth 112 of the first gear 110 engage the teeth 118 of the second gear 116, and a connector 130 connects the second gear and the locking member 122. When the hinge assembly 58 is in the open position as shown in FIG. 10, the locking member 122 may be in the locked position to secure the hinge assembly in the locked position. When the locking member 122 is in the unlocked position, as shown in FIGS. 11-13, the hinge assembly 58 may be opened or closed. Additionally, as shown in the accompanying figures, the teeth 112 may only be disposed about a portion of the first gear 110 but the teeth may also extend about the entire gear. In this exemplary embodiment, once the locking member 122 is in the unlocked position, the teeth 112 of the first gear 110 may no longer engage the teeth 118 of the second gear 116, which may facilitate folding and unfolding of the hinge assembly 58.

As shown in FIG. 6B, for example, the gears 110, 116 and the locking mechanism 120 may be connected to the first side rail 54 of the frame 52. It will be appreciated that the gears 110, 116 and the locking mechanism 120 may be connected to the second side rail 56 of the frame and/or both side rails depending, for example, upon the intended use of the table. For example, in some instances, a locking mechanism 120 may be disposed on both sides of the table top. In other instances, a single locking mechanism 120 may be used. Thus, it will be appreciated that any suitable number of locking mechanisms 120 may be used. It will also be appreciated that any number, size, shape, configuration and arrangement of gears may be used to connect the cross member 66 and the locking mechanism 120.

The gears 110, 116 may be constructed from injection molded plastic and the locking member 122 may be constructed from relatively strong and rigid materials such as steel. The support structures 32, 34 may also be constructed from steel, which may easily be formed into the desired configuration by known operations such as stamping and bending. It will be appreciated that while the support structures 32, 34, the frame 52 and the locking member 122 may be constructed from metal, and the table top 12 may be constructed from blow-molded plastic, these and other portions of the table 10 may be constructed from other materials and processes. It will also be appreciated that various features of the table 10, such as the support structures 32, 34, the frame 52, and the locking mechanism 120, may have other suitable shapes, sizes, configurations and arrangements depending, for example, upon the size and shape of the table top 12 and/or the intended use of the table.

In operation, the table 10 may be disposed in a folded configuration, as shown in FIG. 4. The table top 12 may be unfolded, as shown in FIG. 3, and the first and second support structures 32, 34 may be moved from the collapsed to the use position, as shown in FIG. 2. Advantageously, when one or both of the support structures 32, 34 are moved from the collapsed to the use position, the table top 12 may be locked in the use position. In particular, for example, when the second support structure 34 is moved from the collapsed to the use position, the second support structure may cause the second cross brace 70 to move from the collapsed to the extended position. The movement of the cross brace 70 may cause the cross member 66 to rotate from a first position to a second position, and this may move the locking member 122 from the unlocked to the locked position. Advantageously, this may allow the table top 12 to be automatically locked in the unfolded position when the second support structure 34 is moved into the extended position. When the table 10 is no longer desired to be used or moved, the second support structure 34 may be moved from the extended to the collapsed position and that may unlock the locking mechanism 120 by moving the locking member 122 from the locked to the unlocked position. When the locking member 122 is no longer disposed in the locked position, then the table top 12 can be moved between the folded and unfolded positions.

One of ordinary skill in the art may appreciate after reviewing this disclosure that the table 10; the table top 12; the support structures 32, 34; the frame 52; the hinge assemblies 58, 60; the cross members 62, 64, 66; the cross braces 68, 70; the locking mechanism 120 and the like may have other suitable shapes, sizes, configurations and arrangements depending, for example, upon the intended use of the table.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A folding table comprising:

a table top comprising a first portion and a second portion, the table top movable between a folded position and an unfolded position;

a frame comprising a first portion connected to the first portion of the table top and a second portion connected to the second portion of the table top;

a hinge assembly connecting the first portion of the frame and the second portion of the frame;

a support structure movable between an extended position and a collapsed position relative to the first portion of the table top;

a cross member disposed at least proximate a center portion of the table top, the cross member movable between a first position and a second position;

a cross brace coupled to the support structure and the cross member, the cross brace movable between an extended position and a collapsed position; and a locking mechanism including a locked position in which the hinge assembly is secured in a fixed position and an unlocked position, the movement of the support structure between the extended and collapsed positions causing the locking mechanism to move between the locked and unlocked positions;

wherein the movement of the support structure from the collapsed position to the extended position causes the cross brace to move from the collapsed position to the extended position;

wherein the movement of the cross brace from the collapsed position to the extended position causes the cross member to move from the first position to the second position; and wherein the movement of the cross member from the first position to the second position causes the locking mechanism to move from the unlocked position to the locked position; and wherein when the support structure is in the extended position and the locking mechanism is in the locked position, the table top is secured in the unfolded position.

2. The folding table as in claim 1, further comprising one or more gears rotationally connecting the cross member and the locking mechanism;

wherein rotation of the cross member between the first and second positions moves the locking mechanism between the locked and unlocked positions.

3. The folding table as in claim 1, wherein the cross brace is connected to the cross member in a fixed position so that movement of the cross brace between the extended and collapsed positions causes rotation of the cross member between the first and second positions; and wherein the cross member is rotationally coupled to the locking mechanism so that rotation of the cross member between the first and second positions causes the locking mechanism to move between the locked and unlocked positions.

4. The folding table as in claim 1, wherein the movement of the support structure from the collapsed position to the extended position causes the following to occur: the cross brace moves from the collapsed position to the extended position, the cross member rotates from the first position to the second position, one or more gears rotate from a first position to a second position, and the locking mechanism moves from the unlocked position to the locked position to secure the table top in the unfolded position.

5. The folding table as in claim 1, wherein the cross member is rotatably connected to the hinge assembly;

wherein the cross member is aligned with an axis of rotation of the table top between the folded and unfolded positions;

wherein the cross member rotates between the first position and the second position;

wherein the cross member is rotatably coupled to the locking mechanism; and wherein the rotation of the cross member locks and unlocks the locking mechanism.

6. The folding table as in claim 1, further comprising one or more gears connecting the cross member and the locking mechanism, the locking mechanism including a locking member movable between a locked position and an unlocked position.

7. The folding table as in claim 6, further comprising one or more flanges of the locking mechanism, the one or more gears being disposed at least proximate the flanges of the locking mechanism.

8. The folding table as in claim 6, further comprising two or more flanges of the locking mechanism, the one or more gears being at least substantially disposed between the flanges of the locking mechanism.

9. The folding table as in claim 1, further comprising a support structure receiving portion in a body of the cross brace sized and configured to receive a portion of the support structure when the support structure and the cross brace are in the collapsed positions.

10. The folding table as in claim 9, further comprising:

a first receiving potion integrally formed in the lower surface of the table top as part of a unitary, one-piece construction, the first receiving portion sized and configured to receive an elongated body of the cross brace when the cross brace is in the collapsed position; and a second receiving portion integrally formed in the lower surface of the table top as part of the unitary, one-piece construction, the second receiving portion sized and configured to receive the support structure receiving portion of the cross brace when the cross brace is in the collapsed position.

11. The folding table as in claim 1, further comprising a support structure receiving portion in the cross brace sized and configured to receive a portion of the support structure when the support structure and the cross brace are in the collapsed positions, the portion of the support structure disposed in the receiving portion is generally aligned with an axis extending through a body of the cross brace.

12. The folding table as in claim 1, further comprising a first plurality of engagement members connected to the cross member, the first plurality of engagement members sized and configured to engage a second plurality of engagement members, the second plurality of engagement members connected to the locking mechanism;

wherein when the first plurality of engagement members engage the second plurality of engagement members, the movement of the first plurality of engagement members moves the second plurality of engagement members, which moves the locking mechanism between the locked and unlocked positions.

13. The folding table as in claim 1, further comprising a first gear connected to the cross member, a second gear engaging the first gear, a locking member connected to the second gear, the rotation of the first gear causing rotation of the second gear and movement of the locking member between the locked and unlocked positions.

14. A method of securing a folding table in a locked position or an unlocked position by moving a support structure between a collapsed position and an extended position, the folding table including a table top with a first portion and a second portion movable between a folded position and an unfolded position, a hinge assembly connecting the first portion of the table top and the second portion of the table top, a support structure movable between an extended position and a collapsed position relative to the first portion of the table top, a cross member movable between a first position and a second position, a cross brace coupled to the support structure and the cross member, and a locking mechanism including a locked position in which the hinge assembly is secured in a fixed position and an unlocked position, the method comprising:

disposing the folding table with the table top in the unfolded position and the support structure in the collapsed position; and moving the support structure from the collapsed position to the extended position, which causes the cross brace to move from the collapsed position to the extended position, which causes the cross member to move from the first position to the second position, which causes the locking mechanism to move from the unlocked position to the locked position;

wherein the cross brace is connected to the cross member in a fixed position so that movement of the cross brace between the extended and collapsed positions causes rotation of the cross member between the first and second positions; and wherein the cross member is rotationally coupled to the locking mechanism so that rotation of the cross member between the first and second positions causes the locking member to move between the locked and unlocked positions.

15. The method of securing a folding table in a locked position or an unlocked position by moving a support structure between a collapsed position and an extended position as in claim 14, wherein when the support structure in the extended position and the locking mechanism is in the locked position, the table top is secured in the unfolded position.

16. The method of securing a folding table in a locked position or an unlocked position by moving a support structure between a collapsed position and an extended position as in claim 14, wherein one or more gears rotationally connect the cross member and the locking mechanism, the cross member rotates between the first and second positions, and the rotation of the gears moves the locking mechanism between the locked and unlocked positions.

17. A folding table comprising:

a table top comprising a first portion and a second portion, the table top movable between a folded position and an unfolded position;

a frame comprising a first portion connected to the first portion of the table top and a second portion connected to the second portion of the table top;

a hinge assembly connecting the first portion of the frame and the second portion of the frame;

a support structure movable between an extended position and a collapsed position relative to the first portion of the table top;

a cross member connected to the hinge assembly, the cross member rotatable between a first position and a second position;

a cross brace coupled to the support structure and the cross member, the cross brace movable between an extended position and a collapsed position;

a locking mechanism rotatably coupled to the cross member, the locking mechanism including a locked position and an unlocked position;

at least a portion of a first gear connected to the cross member;

at least a portion of a second gear connected to the first gear; and a locking member connected to the second gear, the rotational movement of the cross member between the first and second positions causing the first gear to rotate, the second gear to rotate and the locking member to move between the locked and unlocked positions.

wherein movement of the support structure between the extended and collapsed positions causes the locking mechanism to move between the locked and unlocked positions; and wherein when the support structure is in the extended position and the locking mechanism is in the locked position, the table top is secured in the unfolded position.

* * * * *

UNITED STATES PATENT AND TRADEMARK OFFICE

CERTIFICATE OF CORRECTION

PATENT NO. : 8,555,791 B2
APPLICATION NO. : 13/559003
DATED : October 15, 2013
INVENTOR(S) : Jin et al.

It is certified that error appears in the above-identified patent and that said Letters Patent is hereby corrected as shown below:

In the Specification

In Column 1, Line 15, delete "entirety" and insert -- entirety. --, therefor.

In Column 1, Line 22, delete "unfolded" and insert -- unfolded. --, therefor.

In Column 13, Line 60, delete "locking member 120" and insert -- locking member 122 --, therefor.

In the Claims

In Column 20, Line 12, in Claim 17, delete "positions." and insert -- positions; --, therefor.

Signed and Sealed this
Twenty-sixth Day of November, 2013

Margaret A. Focarino

Margaret A. Focarino
*Commissioner for Patents of the United States Patent and Trademark Office*